US005660113A

United States Patent [19]

Lehotsky

[11] Patent Number: 5,660,113

[45] Date of Patent: Aug. 26, 1997

[54] AERIAL CABLE SUPPORT SYSTEM FOR SNOW SKI JUMPING

[76] Inventor: Ronald M. Lehotsky, 5747 Holden St.-#4, Pittsburgh, Pa. 15232

[21] Appl. No.: 573,195

[22] Filed: Dec. 15, 1995

[51] Int. Cl.[6] ..... B61B 7/00

[52] U.S. Cl. ..... 104/113; 104/115; 104/173.1; 104/173.2

[58] Field of Search ..... 104/173.1, 173.2, 104/112, 113, 115, 87, 53, 62, 69, 82, 116; 212/76; 482/71, 69

[56] References Cited

U.S. PATENT DOCUMENTS

| | | | |
|---|---|---|---|
| 318,627 | 5/1885 | Keller | 104/113 |
| 1,859,180 | 5/1932 | Thiel | 104/113 |
| 3,861,318 | 1/1975 | Massa | 104/113 |
| 4,359,946 | 11/1982 | Marvin | 104/93 |
| 4,934,277 | 6/1990 | Smith et al. | 104/113 |
| 5,224,425 | 7/1993 | Remington | 104/53 |

FOREIGN PATENT DOCUMENTS

| | | | |
|---|---|---|---|
| 769447 | 10/1967 | Canada | 104/173.2 |
| 277314 | 12/1969 | Germany | 104/173.2 |
| 2437557 | 2/1976 | Germany | 104/113 |
| 2636888 | 5/1977 | Germany | 104/173.2 |
| 3134909 | 3/1983 | Germany | 104/173.2 |
| 9014977 | 12/1990 | WIPO | 104/173.2 |

*Primary Examiner*—Mark T. Le

[57] ABSTRACT

A support system that allows skiers and snow boarders to descend from cliffs and other elevated surfaces while eliminating the high speed impact landing after the descent. Aerial cables (10 and 12), suspended between towers (14 and 16), provide a path for transporting pulleys (18 and 20). Attached to pulleys, support lines (22 and 24) gradually carry the skier in harness (26) towards landing area (32) after the skier experiences a limited free-fall. While skiing down launch area (28), break-away attachments (46 and 48) keep the pulleys in the same plane as the sider and also retain partial slack in the support lines until free-fall begins. After siding from edge of ramp (30), the skier's weight pulls on the support lines causing the break-away attachments to release the partial slack held in each support line. The sider is in free-fall for a distance predetermined by the length of slack in the support lines. The support lines, consisting of semi-elastic nylon material, decelerate the sider and prevent further free-fall descent. After the free-fall, the pulleys transport the skier who is suspended from the support lines towards the landing area. Once at the landing area, the skier gently touches down to the ground with a moderate lateral speed and a near zero vertical speed. The skier has completed a very high cliff jump without having a high speed impact landing with the ground. Additionally, skiers have the option to select a no free-fall jump but still have the experience of siding from a cliff. For a no free-fall option, intermediate loops (34 and 36) attach directly to carabiners (38 and 40). This connection sequence by-passes the break-away attachments and prevents the skier from having the limited free-fall.

7 Claims, 4 Drawing Sheets

AERIAL CABLE SUPPORT SYSTEM FOR SNOW SKI JUMPING

BACKGROUND—FIELD OF INVENTION

This invention relates to snow skiing, specifically to a skier support system that allows skiers to jump from cliffs and other elevated surfaces while eliminating a high speed impact landing.

BACKGROUND—DISCUSSION OF PRIOR ART

Popular ski films, ski magazines, and 'extreme' skiers commonly display the dare-devil act of cliff jumping. Such a stunt has gained notoriety in skiing scenes because it is exciting, dangerous, and entertaining to watch. Although frequently portrayed in advertisements, cliff jumping is not practical for the average skier without assuming a high risk of serious injury. This exclusivity to the expert skier exists because of the precision required for landing. Expertise is not required for the take off.

Heretofore, skiing from highly elevated surfaces such as cliffs, boulders, ramps, and large mounds of snow inevitably resulted in a high speed impact landing. A typical cliff jump can have a 9 meter (30 ft.) free-fall, after which a skier is accelerating and falling very fist. The only prior means to ease the fall was to hope the snow was sufficiently soft to cushion the skier's landing. Without a support system the consequences were many. Skiers often crashed into rocks, accelerated too quickly to be in control upon landing, did not land feet first, or did not land facing forward. These incorrect landings often caused serious injury.

OBJECTS AND ADVANTAGES

Accordingly, several objects and advantages of my invention include the following:

(a) to provide a support system that allows skiers to experience a descent from an elevated surface without having a high speed impact with the ground below;

(b) to provide a support system which minimizes the dangers involved with jumping including not landing feet first, not landing facing forward, landing too fist, colliding with obstacles at the bottom, and not touching down gradually;

(c) to provide a support system made of high strength materials for safety and reliability;

(d) to provide a support system designed with a redundancy of safety factors, secure attachments, and independent supports;

(e) to provide a support system where the average skier can perform the stunt of cliff jumping which was once reserved only for the expert extreme daredevil skier.

Further objects and advantages are to provide a support system which can allow skiers to descend from cliffs, elevated ramps, or large mounds of snow, and which can allow skiers to practice aerial maneuvers such as twists and flips, and which can allow skiers to practice Olympic-style long distance jumping, and which provides a gentle and gradual touch down landing, and which provides the skier with the option of having a no free-fall or a limited free-fall descent, and which can allow snow boarders to experience the same as above. Still further objects and advantages will become apparent from a consideration of the ensuing description and drawings.

DETAILED DESCRIPTION OF A PREFERRED EMBODIMENT

Figure 1:
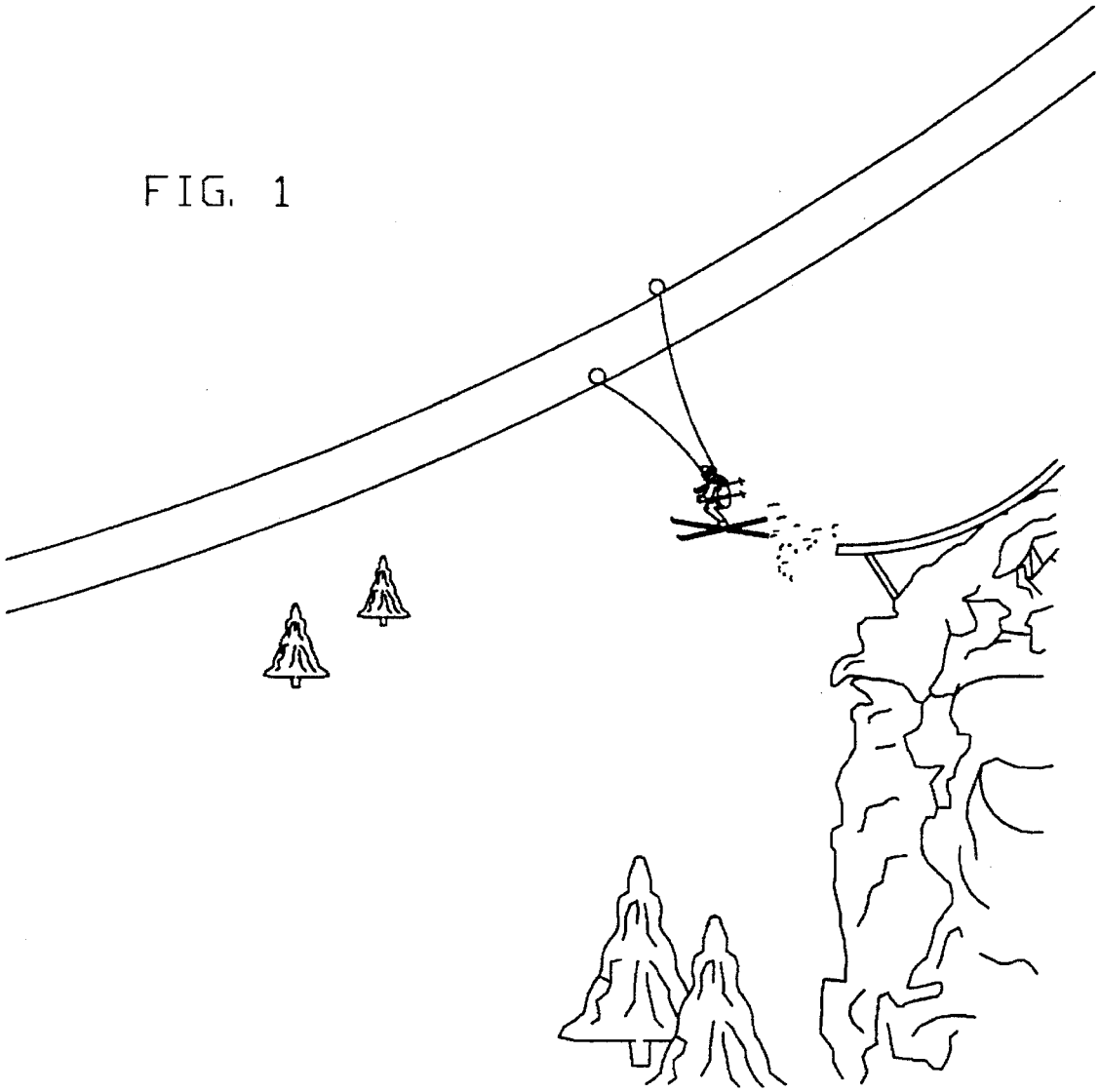
FIG. 1 is a perspective view of a cliff ski jump which illustrates the function of my invention.

FIG. 1 illustrates the function of the support system by showing a skier descending from a ski jump located on a cliff. Since the support system can have a length of more than 305 meters (1,000 ft.), this informal drawing best portrays my invention's use. Such a cliff setting has a typical height of 15 meters (50 ft.).

Figure 2:
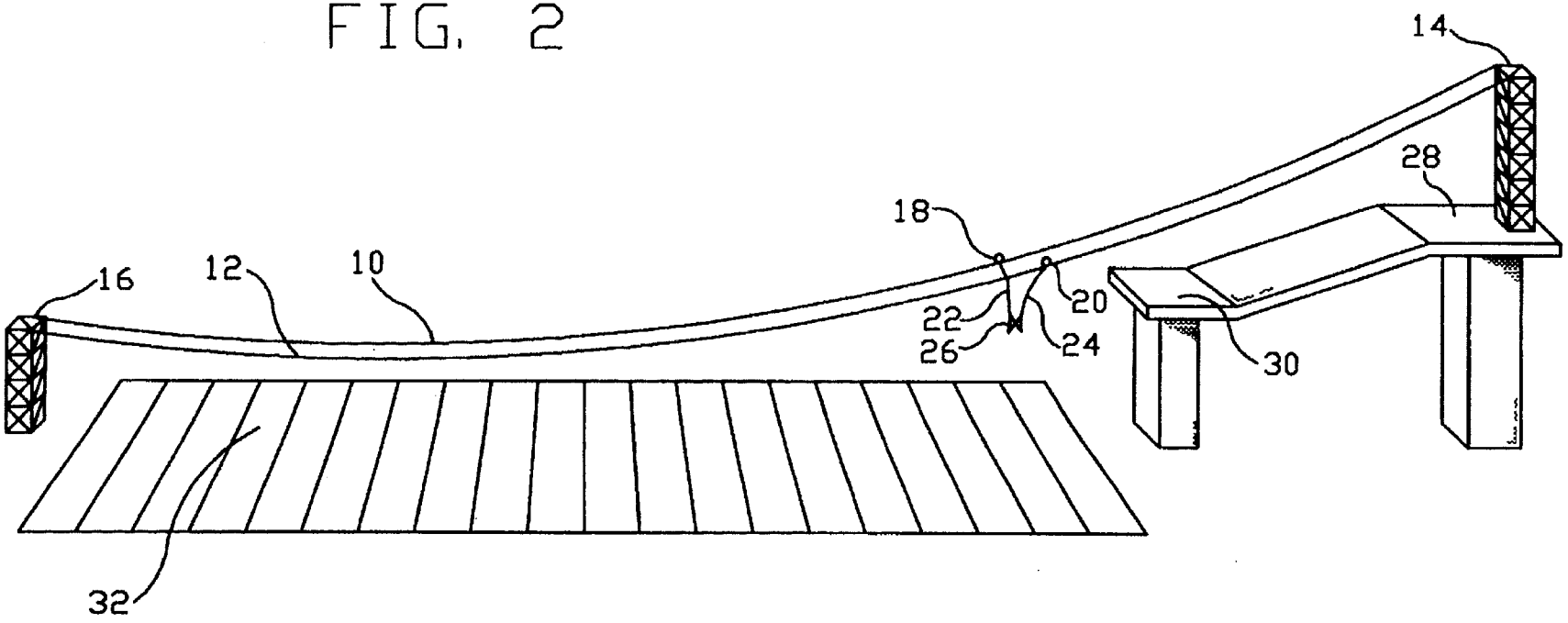
FIG. 2 is an isometric schematic view of my invention showing the overall support system.

FIG. 2 (isometric view) illustrates a typical embodiment of the overall support system of the present invention. The support system has in parallel a right aerial cable 10 and a left aerial cable 12, typically separated by a distance of 4.5 meters (15 ft.). The aerial cables, also commonly referred to as 'wire rope' in the industry, have a typical diameter between 0.95 cm (⅜ inch) and 2.54 cm (1 inch). The two aerial cables are tautly suspended between an upper cable support tower 14 and a lower cable support tower 16. The horizontal distance from cable end to cable end can range from about 61 meters (200 ft.) to over 305 meters (1,000 ft.), depending on the length of the exact terrain setting. A typical vertical distance between cable ends is such that a rise:run ratio is approximately 1:10. Therefore, the angle of inclination in a straight line between the two support towers is about 6 degrees. The aerial cables, of course, cannot be suspended between the two towers in a perfectly straight line. Due to flexure or sagging under their own weight, the cables will inevitably have a slight arc or curvature when suspended between the towers. Optimal angle of inclination of the cables ranges approximately between 5 and 10 degrees. The angle of the cables will be steeper near the upper support tower due to the curvature from sagging. FIG. 2 also shows a launch area 28 from where the skier starts, a ramp 30 at the jump's edge, and a landing area 32 where the skier touches down.

Figure 3:
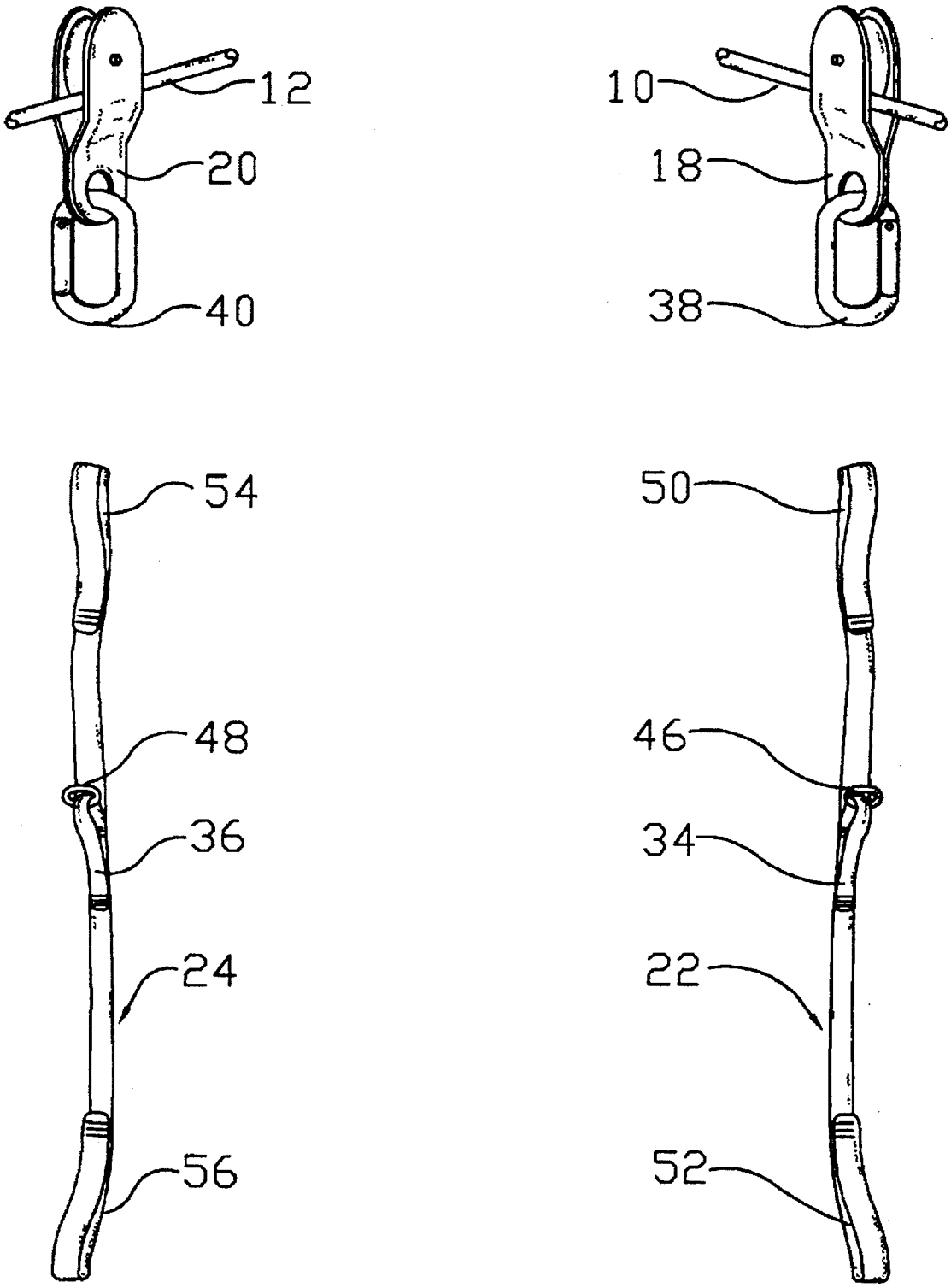
FIG. 3 is a perspective view which shows the details of pulleys and support lines used in the system of FIGS. 1 and 2.

FIG. 3 shows details of pulleys and support lines. Attached to right aerial cable 10 is a right pulley 18. Attached to left aerial cable 12 is a left pulley 20. Standard one-wheeled pulleys are available through CMI in Franklin, W. Va. The corresponding size pulley is chosen to fit the diameter of cable that is used. A right rider support line 22 connects to the right pulley by a right carabiner 38. The connect point is at a right first end 50 of the right support line. A left rider support line 24 connects to the left pulley by a left carabiner 40. The connect point is at a left first end 54 of the left support line. For clarity, the support lines are shown detached from the carabiners. Carabiners, commonly used in rock climbing, have a hinged gate which opens for clipping onto ropes and other attachments. Each support line is made of dynamic nylon material which is manufactured to provide a percentage of elasticity and elongation when force is applied to it. It is lightweight yet very strong with a tensile strength of 26,600 Newtons (6,000-lbs). This type of nylon, also used in rock climbing, is available through CMI in Franklin, W. Va.

Approximately at the mid-point of each rider support line is an intermediate loop. The right rider support line has a right intermediate loop 34. The left rider support line has a left intermediate loop 36. A right break-away attachment 46 ties onto right intermediate loop 34. A left break-away attachment 48 ties onto left intermediate loop 36. The break-away attachments are made of low strength material such as plastic or string. For clarity, the break-away attachments are shown unclipped from their carabiners. Right break-away attachment 46 clips into right carabiner 38. Left break-away attachment 48 clips into left carabiner 40.

Figure 4:
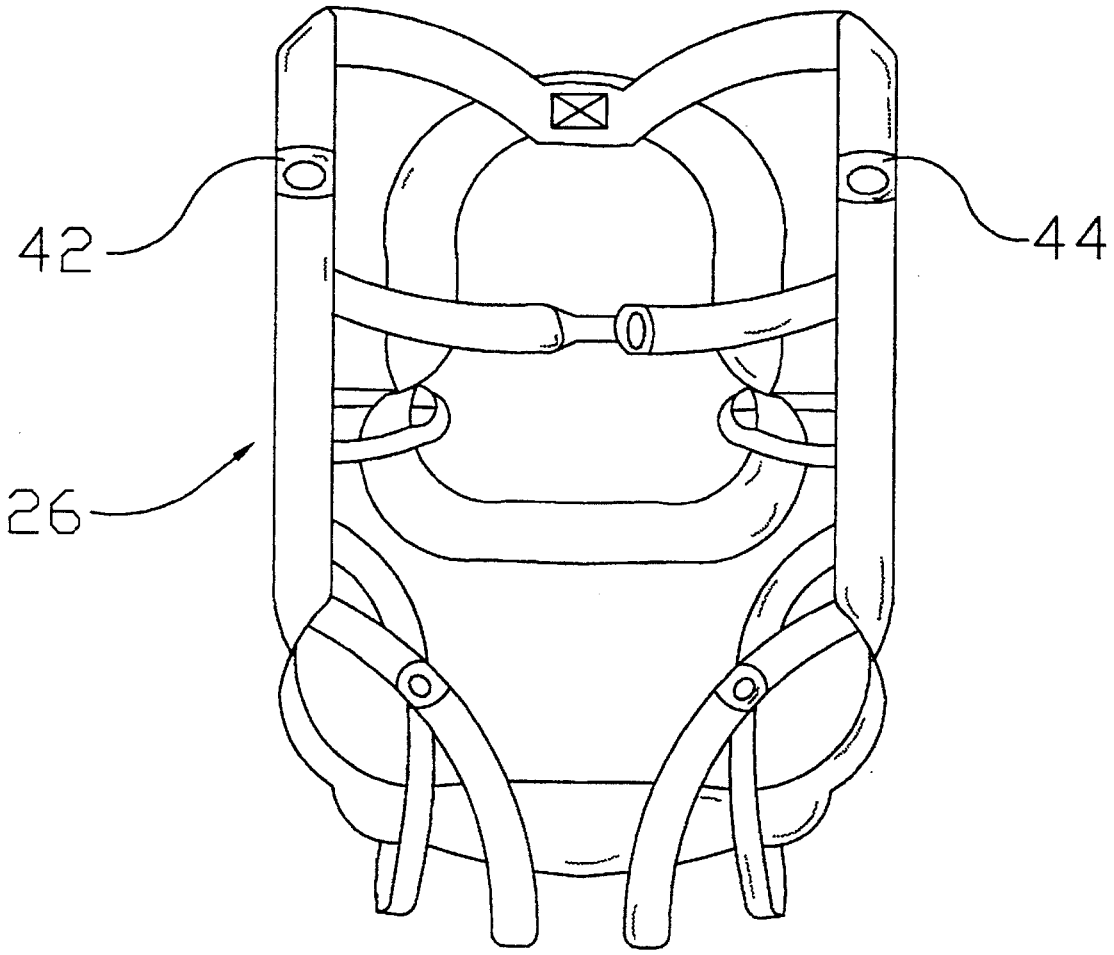
FIG. 4 is a perspective view in detail of a harness worn by the skier using the system of the present invention.

FIG. 4 shows a detailed view of the skier harness. Each support line connects to a skier harness 26. The harness is a full-body, seat-style harness similar to those worn by parachutists. A right second end 52 of the right support line connects to the harness at a harness right connection 42. A left second end 56 of the left support line connects to the harness at a harness left connection 44. The harness right and left connections are an integral part of the harness. They are located near the shoulder where parachute lines would attach.

Operation of Invention

The manner of using the aerial cable support system is by first having the skier don harness 26. The harness is a full-body, parachute-style harness. The harness will support the skier and distribute her weight around the thighs, buttocks, and waist after the free-fail. The skier harness connects to rider support lines 22 and 24. Right second end 52 of the right rider support line attaches at harness right connection 42. Left second end 56 of the left rider support line attaches at harness left connection 44. Right and left first ends, 50 and 54, of the rider support lines connect to carabiners 38 and 40, respectively. Break-away attachments 46 and 48 also connect to carabiners 38 and 40, respectively. Each break-away attachment remains clipped to its respective carabiner until significant force (≧133 Newtons=30-lbs) is applied to open the break-away attachments. The break-away attachments serve two purposes. First, the attachments keep pulleys 18 and 20 near the skier. When the skier commences skiing from launch area 28, the pulleys will remain approximately in the same plane as the skier along aerial cables 10 and 12. Secondly, the break-away attachments act as slack retainers. Temporarily retaining the slack will allow for the free-fall once the slack is released. The right break-away attachment will temporarily retain slack in the right support line. The left break-away attachment will temporarily retain slack in the left support line. Once the skier is secured in the harness find all connections are in place, she proceeds down the launch area. The skier glides off ramp 30, descends over the edge, and becomes airborne.

Once airborne and accelerated by gravity, the skier's weight pulls on each support line causing the break-away attachments to break open and release the slack. The skier then descends in a limited free-fall. When the predetermined free-fail distance has been reached, rider support lines 22 and 24 absorb the skier's fall and prevent any further descent relative to the aerial cables. With tension in each support line the skier continues forward towards landing area 32. The skier is transported along each aerial cable by the two pulleys. The angle of the aerial cables is such that the skier is riding along the cables with a forward and gradual downward motion. This forward and gradual downward motion is achieved by having the cables slightly angled downward. Due to friction acting between the pulleys and cables, the optimal angle is approximately between 5 and 10 degrees. The skier's motion is mostly in the horizontal direction, but also has a slight vertically downward direction. Once the skier reaches the landing area, her velocity is a modest lateral speed (about 6.7 km/hr=15 mph), her downward speed is minimal (about 1.3 km/hr=3 mph), and her body position is facing forward with skis touching down first. The skier lands under controlled conditions, disconnects from the harness, and has completed a fifty foot cliff jump without a high speed impact landing.

The support lines typically range in length from at least 2.1 meters (7 ft.) up to 7.3 meters (25 ft.) or more. The varying lengths provide for different free-fall distances. The support lines also provide the skier with the option to eliminate the free-fall. To eliminate free-fall, intermediate loops 34 and 36 are clipped directly into their respective carabiners. In this connection sequence the support lines will not release the slack, but the skier will still have the exciting experience of skiing from a cliff.

Summary, Ramifications, and Scope

Variations

Thus the reader will see that the support system of the invention provides a highly effective and practical method for the average skier to experience the stunt of cliff jumping. While my above description contains many specificities, these should not be construed as limitations on the scope of the invention, but rather as an exemplification of one preferred embodiment thereof. Many other variations are possible. For example, as mentioned above, the break-away attachments could be by-passed and the intermediate loops could connect directly to their respective carabiners. This would eliminate the free-fall, but still provide the experience of skiing from a cliff.

One alternative method for retaining slack and initiating the free-fall is to have an overhead track instead of break-away attachments. The overhead track would extend slightly past the ramp's edge. The intermediate loops would be guided along the overhead track. Once the skier is about five feet past the ramp, the track ends and the free-fall begins. Another alternative method to retain slack is using spring clamps instead of break-away attachments. The spring clamps would hold the intermediate loops until the skier becomes airborne. Regarding skier options, having varying lengths of support line allows the skier to select various free-fall distances. For example, the skier could select a five, ten, or fifteen foot free-fall. Regarding the support line, three intermediate loops could be placed along a single support line about five feet apart. This would allow the same support line to be used for varying free-fall distances. Support line construction could also be made from static (non-elastic) nylon webbing and a shorter length of elastic cord in parallel. The elastic cord absorbs the fall and the high strength nylon webbing supports the skier after the free-fall. As another alternative, steel cables in parallel with shorter elastic cord could be used for the support lines.

One Or TWO Aerial Cables

In the above operation, two aerial cables and two support lines have been used which provides a redundancy of safety. Using two cables and two support lines also causes the skier to land facing forward upon touching down. This is due to the rotational forces returning to equilibrium or tending to the state of lowest potential energy (similar to when a playground swing is twisted and released, the swing rotates back to its neutral position). My invention is also functional if only one aerial cable is used with one or two rider support lines. Of course if one cable is used with one rider support line, the support line attaches to a center point on the back of the skier harness.

Other Applications

In addition to descending from cliffs, ramps, and moguls of snow, the support system can have Olympic practice application. To date there is no method for the 90-meter ski jumpers to practice their take-off techniques while eliminating the landing. The same problem exists for the Olympic freestyle jumpers to practice their twists and flips. A slightly modified version of my aerial cable support system can be applicable to both. For example, a 90-meter jumping version would not require a free-fall or even a touch down landing for the skier to focus solely on the take-off techniques. Also, a free-style jumping version would employ a special harness that allows both twisting and head over heals motion. These harnesses are worn by gymnasts and divers when practicing on trampolines.

In addition to down-hill or alpine skiers, other types of skiers could utilize the same system. This includes snow boarders, tele-mark skiers, and cross country skiers. Even mountain bikers could descend if equipped with a harness for holding their bikes in a suitable position.

Scope

Accordingly, the scope of the invention should be determined not by the embodiments illustrated, but by the appended claims and their legal equivalents.

I claim:

1. An aerial cable support system simulating ski jumping for eliminating high speed impact landings resulting from extreme jumps, the support system comprising:

an upper support structure, a lower support structure, and at least one aerial cable suspended between said upper and lower support structures, said aerial cable being arranged at an elevation to suspend a skier above ground along at least a major portion of the length of the aerial cable;

a skier accelerating runway area at the upper support structure, and a skier decelerating landing area at the lower support structure;

a skier support line having a first end and a second end, said first end attached to said aerial cable by means of a transportable connection adapted for moving along said aerial cable;

a skier harness attached to said second end of said skier support line.

2. The aerial support system of claim 1 wherein said upper cable support structure is located up-hill from said runway area yielding a path-way whereby a skier accelerates and executes an approach prior to descending from a ramp.

3. The aerial support system of claim 1 wherein said lower support structure is located beyond said landing area yielding a path-way whereby the skier decelerates and executes a gradual touch-down landing.

4. The aerial support system of claim 1 wherein said support line contains a slack retainer for holding temporary slack, whereby when a skier departs from said runway area, the skier descends in a limited free-fail due to pay-out of said temporary slack upon application of the skier weight to said support line.

5. The aerial support system of claim 4 wherein said slack retainer is a break-away attachment made of low-strength plastic.

6. A ski jump simulator eliminating the high speed impact landing involved with cliff jumping, the support system comprising:

upper and lower support towers, and at least one aerial cable suspended between said upper and lower support towers, said aerial cable being arranged at an elevation to suspend a skier above ground along at least a major portion of the length of the aerial cable;

a skier launch area at the upper support tower and containing a pathway for accelerating along an approach leading to a ramp;

a skier landing area at the lower support tower and with a length of path-way for decelerating in a gradual touch-down landing;

a skier support line having a first end and a second end, said first end attached to said aerial cable by means of a transportable connection adapted for moving along said aerial cable, said second end attached to a skier harness.

7. The ski jump simulator of claim 6 wherein said rider support line contains an intermediate loop with means for attaching said intermediate loop directly and permanently to said transportable connection whereby when a skier departs from said ramp the skier becomes air-borne with no free-fall.

* * * * *

UNITED STATES PATENT AND TRADEMARK OFFICE

CERTIFICATE OF CORRECTION

PATENT NO. : 5,660,113
DATED : August 26, 1997
INVENTOR(S) : Lehotsky

It is certified that error appears in the above-identified patent and that said Letters Patent is hereby corrected as shown below:

In the 'Abstract' section:

| Line # | Says | Should Read: |
|---|---|---|
| 10 | sider | skier |
| 12 | siding | skiing |
| 14 | sider | skier |
| 17 | sider | skier |
| 26 | siding | skiing |

In the Specification section:

| Column | Line # | Says | Should Read: |
|---|---|---|---|
| 1 | 25 | fist | fast |
| 1 | 41 | fist | fast |
| 3 | 45 | find | and |
| 3 | 53 | free-fail | free-fall |

Signed and Sealed this

Sixth Day of January, 1998

Bruce Lehman

*Attest:*

BRUCE LEHMAN

*Attesting Officer*

*Commissioner of Patents and Trademarks*